United States Patent [19]

Johnson

[11] 3,966,544

[45] June 29, 1976

[54] GUIDE SHOWER FOR A FABRIC BELT

[75] Inventor: Henry Johnson, Quebec, Canada

[73] Assignee: JWI Ltd., Montreal, Canada

[22] Filed: Dec. 23, 1974

[21] Appl. No.: 536,924

[30] Foreign Application Priority Data

Jan. 9, 1974 United Kingdom ..... 945/74

[52] U.S. Cl. ..... 162/199; 162/275; 239/562

[51] Int. Cl.[2] ..... D21F 1/42

[58] Field of Search ..... 162/199, 272, 273, 274, 162/275, 277, 310, 348; 134/15, 32; 209/380; 198/208, 230; 210/391, DIG. 3; 239/443, 444, 559, 561, 562, 564, 566, 567

[56] References Cited

UNITED STATES PATENTS

| | | | |
|---|---|---|---|
| 1,989,435 | 1/1935 | Wallquist | 162/310 X |
| 3,574,338 | 4/1971 | Shelor | 239/562 X |
| 3,826,431 | 7/1974 | Telge et al. | 239/562 X |
| 3,830,691 | 8/1974 | Truesdale et al. | 162/273 |

*Primary Examiner*—S. Leon Bashore
*Assistant Examiner*—Richard V. Fisher
*Attorney, Agent, or Firm*—Alan Swabey & Co.

[57] ABSTRACT

This invention relates to a method and apparatus for guiding endless woven fabric belts such as are used on paper making machines. Specifically, the instant application teaches the use of a guide shower, which is disposed across the width of the endless belt, to provide the guiding action. The shower comprises a series of nozzles which are adapted to be directed at one edge or the other of the endless belt. Three separate embodiments are disclosed. In one of the embodiments, the shower pipe connecting the nozzles is divided into a left side and a right side. The nozzles on the left side are all directed at the left edge of the endless belt whereas the nozzles on the right side are directed at the right edge of the endless belt. In a second embodiment, two parallel shower pipes are disclosed, the nozzles of one of the shower pipes all being directed at the left edge of the endless belt, the nozzles of the other pipe all being directed at the right edge of the endless belt. In a third embodiment, a series of swivelling nozzles are mounted on the shower pipe. The direction of the nozzles is adjusted in response to signals from a sensing device so that all of the nozzles on the pipe are pivoted towards one or the other of the edges of the endless belt.

24 Claims, 7 Drawing Figures

PRIOR ART

GUIDE SHOWER FOR A FABRIC BELT

BACKGROUND OF THE INVENTION

1. Field of the Invention

This invention relates to a method and apparatus for guiding endless woven fabric belts. Such fabric belts are used, for example, on Fourdrinier paper making machines. More specifically, this invention relates to such an apparatus which comprises a shower head and nozzles.

2. Description of the Prior Art

In such machines, paper is formed by first flowing a thin suspension of stock fibres in water from a head box slice onto the upper surface of a moving endless belt. As the belt then travels in contact with the table rolls or foils and suction boxes in the forming section of the machine, water is withdrawn from the stock through the belt, leaving a thin formation of self-supporting, matted fibres on the upper surface of the belt. The sheet of formed fibres is lifted off the belt at a couch roll at the downstream end of the forming section and the belt, after travelling around the couch roll, is returned through a series of return rolls to the upstream end of the machine where it travels around a breast roll and again passes under the slice and then to the forming section to complete the cycle which is continuous. The self-supporting matte of fibres, removed at the couch roll, passes to a press section where more water is removed by squeezing it at the nip of press rolls while sandwiched between layers of felt material also made up as endless belts. The remaining water is removed by passing the sheet of matted fibres over steam heated rolls under endless dryer felts in the dryer section of the machine.

The endless belts employed in the forming section of the paper machine are generally woven from synthetic monofilament or multifilament yarns or from metal strands such as bronze or stainless steel or from a combination of these materials. Belts employed in the press section are generally felted material having a base fabric of woven or non-woven natural or synthetic fibre yarns. The dryer belts are generally made of relatively heavy fabric woven of natural or synthetic fiber yarns containing fibres of heat resisting mineral. In any case, a belt runs like a conveyor belt over machine components and is subject to stress variations which can upset stability to cause it to run spirally towards one or the other side of the machine. It may also happen that a woven belt of any of these types has a built-in bias which tends to make it run consistently towards one side of the machine. It is therefore necessary to provide a means to continuously guide the belt and keep it centered.

It has usually been the practice to keep the belt running truly in the center of the machine by means of a guide roll over which the belt runs in the return section of the machine. The guide roll can be moved at one end transversely to its axis and in the plane of the machine to steer the belt and tend to keep it on its course. The end of the roll is usually moved by a pneumatic, hydraulic or mechanically driven system which is controlled by a sensing device at one edge of the belt. In operation, when the belt runs towards one side of the machine the edge of the belt activates the sensing device which in turn activates the drive mechanism to offset the end of the guide roll in such a way that the belt is steered towards the opposite side of the machine.

A disadvantage of the known method of guiding the belt, particularly on the slower operating machines, is that the reaction to the steering effect of the guide roll is delayed because the displacement of the end of the guide roll is necessarily quite small and the belt must make many revolutions on the machine before any appreciable amount of belt displacement is realized. Thus, in the case of belts that are accidentally influenced to run off one side of the machine, the corrective action may come too late to be effective in preventing damage to the belt.

A further disadvantage, particularly in the case of wide, high speed paper machines, is that the guide roll, like other rolls in the system, must be large in diameter to counteract deflection, and the mechanism to effect displacement of one end of the roll must be correspondingly large and powerful thus making it expensive to provide and maintain.

It is also known to use showers in association with paper making machines. Although the showers are normally used for the purpose of cleansing the endless belt fabric, U.S. Pat. No. 3,830,691, Truesdale et al., issued Aug. 20, 1974 teaches a specialized use for such a shower. Specifically, the shower is employed in the Truesdale et al. patent for the purpose of spreading the fabric in a low tension part of the run.

SUMMARY OF THE INVENTION

The present invention relates particularly to the guidance of an endless fabric belt such as is used on the forming section of a paper making machine and offers a novel way of steering the belt without resorting to the use of a guide roll and the power driven system for moving one end of the roll. In accordance with the invention a high pressure shower is adapted to function as the motivating force to guide the belt. This is accomplished by activating or directing nozzles of the shower toward the left or right edges of the belt and supplying fluid under high pressure to impinge on the surface of the belt either towards the right or left side as required to overcome the tendency of the belt to run towards the opposite side. The shower pipe should be located close to the surface of the return, low tension, run of the belt and should extend along the width of the belt and in parallel alignment with the lower run, positoned approximately at right angles to the direction of run. The shower head would be very similar to the high pressure oscillating shower used to unplug the mesh of the belt of particles of pitch, filler material, etc. In fact with suitable modification it is within the scope of the invention to adapt the high pressure cleansing shower to perform both the functions of cleaning and guiding the belt.

In the preferred embodiment the guiding function is obtained by having two sets of fixed nozzles, one set directed towards the right and the other set directed towards the left side of the belt and controlling the flow of fluid so that either set of nozzles may be activated as required.

The invention is characterized in that nozzles are spaced at intervals along the shower pipe and are angled from said pipe so that fluid emerging under pressure from the nozzles is directed to impinge substantially toward one edge or the other of the belt at an angle between 10° and 60° to the surface of the belt with angles between 20° and 30° being the most preferred.

Although the disclosure discusses the angle of impingement, it is, of course, clear that this angle will be equal to the acute angle between the nozzles and the shower head. In actual practice, it is the angle between the nozzles and the shower head which is set and measured.

It is also within the scope of the invention to provide fish tail (fan) type jets instead of needle jets if, under certain conditions, these are found to be more effective. Fish tail jets, as will be explained later, might be more effective in providing additional cleaning action to dislodge particles of dirt, etc. from the mesh of the belt as well as imparting guiding action.

The vertical distance of the nozzles from the surface of the belt will depend upon the fluid used. For example, if the fluid is water a vertical distance between one and six inches is preferred. If, on the other hand, air is used, the vertical distance should preferably not exceed ½ inch in order to be most effective. In either case the vertical distance will also depend upon the type of nozzle used.

The invention is not limited to use on a Fourdrinier type forming section but may also be applied to a type of forming section which employs more than one endless fabric such as, for example, that of a Vertiforma, Bell-Baie Former, Papri-Former, etc.

Further, the invention is not limited to the forming section of a paper machine but may also be adapted for use in the press section or in the dryer section to replace the conventional guide rolls. In the dryer section, according to the invention, compressed air would normally be used as the motivating force to guide the dryer belt to avoid adding water to the system. The invention may also be used to guide any other belt or travelling sheet of material which is capable of intercepting and absorbing the momentum of jets of fluid striking its surface at a shallow angle.

BRIEF DESCRIPTION OF THE DRAWINGS

The invention will be better understood by an examination of the following description, together with the accompanying drawings in which.

DETAILED DESCRIPTION OF THE DRAWINGS

Figure 1:
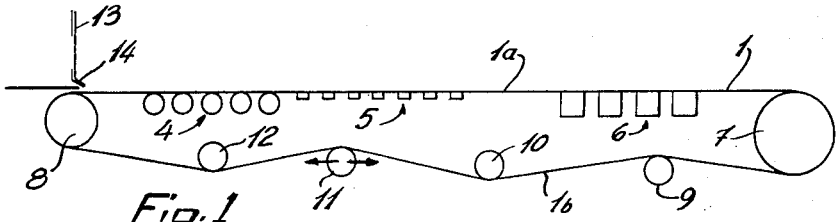
FIG. 1 is a side view of a known conventional Fourdrinier section.

Referring to FIG. 1, in the conventional Fourdriner section of a paper making machine a Fourdrinier fabric in the form of an endless belt 1, having an upper run 1*a* and a lower run 1*b*, is driven over dewatering devices comprising table rolls 4, foils 5 and suction boxes 6 by a couch roll 7. In the lower or return run the belt runs over a wash roll 9, a tensioning roll 10, a guide roll 11 and return roll 12. The belt then passes around a breast roll 8 to return it to the upper run 1*a*. The stock suspension is delivered to the wire from head box 13 by the slice 14. In order to overcome a tendency for the belt to run to one or other side of the machine, one end of guide roll 11 is moved either in the upstream or downstream direction as indicated by the arrows, shown at 11, to steer the wire and correct for the off-running tendency. The mechanism for moving the end of the guide roll and the sensing means, usually a guide palm in contact with the edge of the belt,, are not shown.

As discussed in the above-mentioned U.S. Pat No. 3,830,691 the endless belt comprises a high tension run and a low tension run. In FIG. 1, the high tension run is the run 1*a* and the low tension run is the run 1*b*. The guide means will normally be disposed in the low tension run of the endless belt as lateral displacement of the belt is more easily accomplished in the low tension run than in the high tension run. Thus, in FIG. 1, the guide roll 11 is disposed in the low tension run 1*b* of the endless fabric 1.

Figure 2:
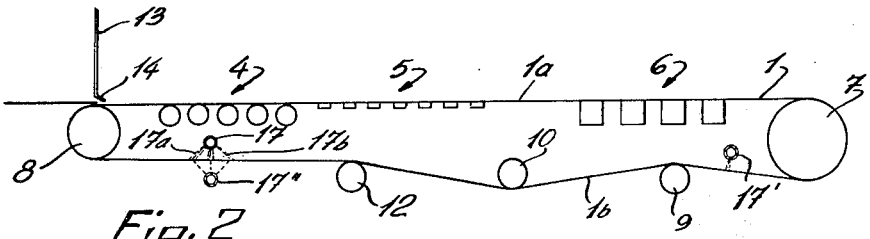
FIG. 2 shows alternate locations for the shower head in accordance with the invention.

As illustrated in FIG. 2 the guide roll 11 has been replaced by guide shower 17 according to the invention, and again, the shower is disposed in the low tension run 1*b*. In some machines, having more than four rolls in the return section, not only can the guide roll be dispensed with but a return roll may also be removed.

Figure 3:
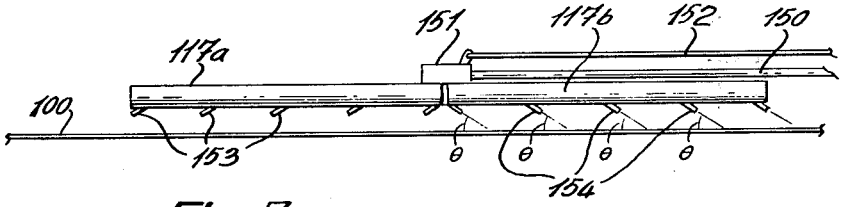
FIGS. 3 and 4 illustrate two embodiments of the shower head in accordance with the invention.

In the embodiment of the invention as shown in FIG. 3, a single shower pipe extending across the endless belt is divided in the center into two independent sections 117A and 117B. Section 117A is provided with a series of nozzles 153 directed towards the left edge of the belt 100 and section 117B is provided with a series of nozzles 154 directed towards the right edge of the belt. A pipe 150 delivers fluid under pressure to valve 151, and valve 151 will direct the fluid to either section 117A or section 117B, but not both, as is well known in the art. Valve control rod 152 is connected to a drive mechanism of a type well known in the art but not shown here and the drive mechanism is activated by a sensing device of a type, also well known in the art but not shown, to activate either the jets in section 117A or the jets in section 117B.

Figure 4:
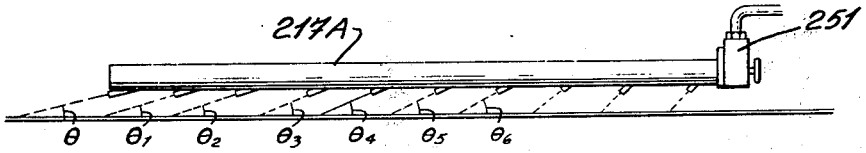
Figure 5:
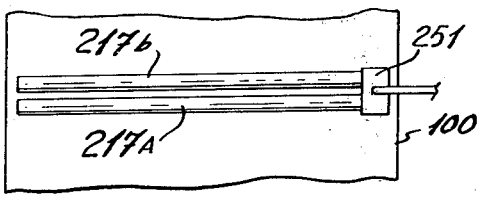
FIG. 5 is a top view of the embodiment illustrated in FIG. 4.

A second embodiment of the invention is shown in FIGS. 4 and 5. In this embodiment the guide shower comprises a single pipe divided into two independent parallel sections along its length or, more simply, twin pipes 217A and 217B as shown. All the nozzles in one section are directed toward one edge of the belt and all the nozzles in the other section are directed towards the other edge of the belt. Fluid under pressure is directed either to pipe 217A or to pipe 217B by valve 251 which is turned by a drive mechanism as in the first embodiment.

Referring again to FIG. 2 the guide shower of either embodiment may be placed at any of several locations, for example, at 17 or 17′ in the return run of the belt and normally will be positioned between the upper and lower runs to extend across the belt parallel to its surface. The nozzles will be located close to the belt and directed so that the jets of fluid will impinge on the inner surface of the lower run, 1*b*, either towards the one side of the machine or the other. In operation, if the belt should commence to run spirally towards, say, the right side of the machine, the sensing means will appropriately cause those nozzles directed towards the left side of the machine to become activated, and the fluid jets, impinging on the belt towards the left edge, will induce a horizontal component of force which will oppose the force tending to cause the belt to spiral towards the right side of the machine. In the event the belt should commence to spiral towards the left side of the machine, the sensing means will cause the nozzles directed towards the right side of the machine to become activated to similarly oppose the tendency of the belt to spiral towards the left side. By proper setting of the sensing means, control of the belt is maintained to keep it running consistently near the center of the paper making machine.

The shower may also be disposed outside of the area enclosed by the endless fabric belt as illustrated at 17'' in FIG. 2. In some sections of the paper making apparatus, such a disposition of the guide shower may be preferable.

The sensing device would normally comprise a guide palm which rests gently against the edge of the fabric on one side and, by its position relative to the machine frame, activates, through a pneumatic servo-system, the mechanism for motivating the control rod 152. Thus, if the fabric 100 moves over, say, to the left, the guide palm will also move towards the left and in doing so activate the servo-system to move the rod 152 so that valve 151 will direct fluid under pressure to the section 117*b*.

In another embodiment of the invention, the guide shower may serve also as a cleansing shower to remove particles of pitch, filler material, etc. from the mesh of the belt. In this case all nozzles are activated continuously while the paper machine is running and guiding is effected by providing a differential in pressure between the series of jets directed towards one side of the machine and the series of jets directed towards the other side. Further, the shower system may be made to oscillate laterally to provide improved overall coverage of the surface of the belt.

In yet another embodiment of the invention, the guide shower arrangement as shown in FIG. 3 may be adapted to serve also as a spreader shower of the type disclosed in U.S. Pat. No. 3,830,691. In this embodiment, all nozzles would be activated continuously and the combined effect of the jets from nozzle series 153 and nozzle series 154 would be to spread the belt from the center outwardly to prevent the formation of ridges while guiding would be effected simultaneously by providing a differential in pressure between the two series of nozzles as required. With suitable nozzle type and/or oscillating means such a shower would serve as a cleansing shower as well.

It will be appreciated that, in the last two mentioned embodiments, the separate sections of the guide shower would not be fed from a common source of fluid under pressure through a valve, but rather, each section would be fed from a separate source of pressure. Accordingly, there would be no need for a valve such as 151 or 152 in the last two mentioned embodiments.

Means, as well known in the art, would be provided for varying the pressure of each of the sources. Again, the level of pressure provided from each output would be controlled through a sensing device such as that previously disclosed herein. Thus, if the endless belt drifted towards the left of the machine, a greater pressure would be provided in the right facing nozzles to guide the fabric in the right hand direction and thereby center the endless belt.

In a consideration of preferred parameters it is known that the maximum possible horizontal component of force exerted by each nozzle varies with the pressure of the fluid, the nozzle diameter, and the angle of impingement of the fluid. Guiding can be achieved with a minimum volume of fluid with high pressure and small nozzle diameter or a larger volume of fluid with lower pressure and larger nozzle diameter. In the case where the fluid is water, the ratio of pressure and volume would normally be selected only after considering the extra volume of water that could efficiently be accommodated by the paper machine. It is usually preferred to minimize the quantity of water added to the system and this can be done most effectively by increasing the pressure and using a small nozzle diameter.

In tests to determine the preferred parameters, it was discovered, surprisingly, that throughout a wide range of impingement angles a fabric belt is capable of absorbing far more energy from a jet of fluid than was expected. For example, a satisfactory horizontal component of force is obtained with an angle of impingement $\theta$ ranging from 10° to 60°. The most satisfactory results were obtained within the range of 20° to 30° and particularly when close to the 20° angle. These results were obtained when the fluid was either water or air.

As for the pressure, it was realized that this would depend upon nozzle size and the number of nozzles required to provide adequate lateral force for guiding the belt. A complete operating range of pressures was not determined. However, satisfactory results were obtained with both air and water at pressures of 100, 200, 400 and 600 psi using nozzle sizes ranging from 0.036 inch to 0.067 inch in diameter. Pressures of 400 – 600 psi are preferred.

Tests conducted to determine optimum distance of the tip of the nozzle from the belt, measured at right angles to the surface of the belt, showed that the results were best, and virtually independent of distance, between 1 and 6 inches when water is the fluid and should preferably be no more than ½ inch when air is used.

In order to avoid the possibility of wrinkling the belt by the application of uneven horizontal force components at some points across its width, particularly where there may be inherent variations in the system so as to inadvertently apply less force at the side to which the nozzles are directed than at the side to which the belt has moved, it is desirable to apply increasingly greater increments of force from the nozzles that are closer to the side toward which the belt is to be guided.

The horizontal component of force can be increased or reduced by changing the angle of impingement or the pressure-nozzle size combination. The preferred way, insofar as this invention is concerned, is to increase the angle of impingement in order to reduce the horizontal component of force and this method is illustrated in FIG. 4 where it is shown that the belt is being guided towards the left side by activation of the nozzles tilted in that direction. It will be apparent that if the jets of fluid at the right hand side of the shower pipe were to exert a stronger influence on the belt than those at the left hand side, there would be a tendency for the belt to buckle and form a ridge somewhere in between its side edges. However, if the force exerted on the belt is gradually increased from the right hand side towards the left hand side as the belt is being urged towards the left hand side, there will be no tendency for the formation of ridges and, in fact, the combined action of the jets, varied in this way, will be to keep the belt flat.

Test results have shown that the greatest horizontal component of force is attained when the angle of impingement is close to 20°. Thus in FIG. 4 the best and safest guiding action is obtained when the impingement angle, $\theta$, at the extreme left hand side of the shower is close to 20° and the angles of other jets impinge at progressively increasing angles $\theta_2$, $\theta_3$, etc., towards the right hand side of the shower. For effective guiding the largest angle, at the right hand end, should not be much greater than 30°.

The force across the width of the belt may also be varied by providing nozzles of progressively larger diameters instead of progressively smaller angles of tilt. This method, however, would have the disadvantage of causing an undesirable pressure drop along the length of the shower pipe which would lessen the effectiveness of the whole system unless nozzles were supplied independently from a constant pressure head.

Although in the above embodiments of the invention fixed nozzles are described, it is alos within the scope of the invention to provide nozzles on swivelling mounts so that, instead of having independent shower pipes for each set of nozzles, a single shower pipe with a single set of swivelling nozzles would be provided. In such a case each nozzle would be directed either towards the left or the right side as required to guide the belt. In this case the mechanism activated by the sensing means would be designed to cause the nozzles to tilt instead of turning a valve.

Figure 6:
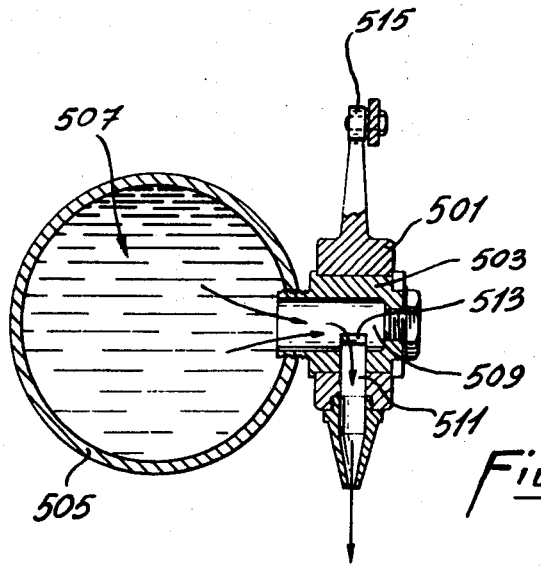
FIG. 6 is a side view of a swivelling mounted nozzle arrangement.
Figure 7:
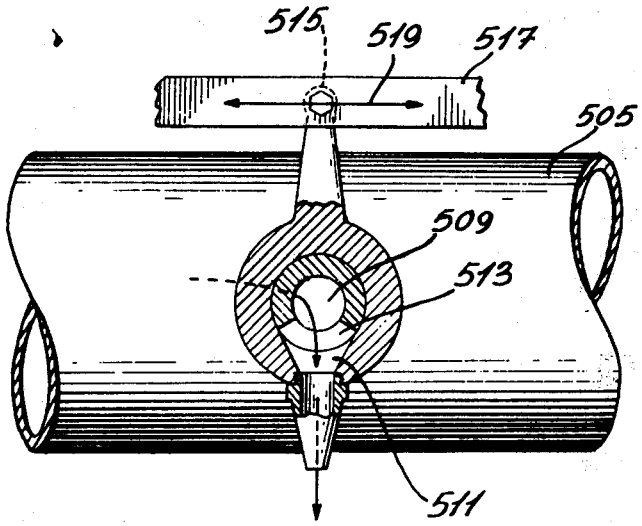
FIG. 7 is a front view of a swivelling mounted nozzle arrangement illustrated in FIG. 6.

An arrangement for mounting a swivelling nozzle is illustrated in FIGS. 6 and 7 hereof. Referring to these Figures, nozzle 501 is pivotably mounted on pipe 503 which is in turn fixedly mounted on pipe 505. Although not shown in the Figures, it will be appreciated that the pipe 505 is mounted to a source of fluid under pressure for providing the fluid under pressure to the nozzles. In addition, although only one nozzle is shown mounted on the pipe 505, the complete length of the pipe will include a plurality of similarly mounted nozzles, and the pipe will then be disposed adjacent a low tension run of the endless fabric belt as at 17, 17′, and 17″ in FIG. 2.

The interior 507 of the pipe 505 communicates with the interior 509 of the pipe 503 which in turn communicates with the interior 511 of the nozzle through an annular opening 513 in the pipe 503. The annular opening 513 is long enough to insure continued communication between 509 and 511 through the entire pivoting range of the nozzle.

The top of the nozzle is pivotably connected at 515 to rod 517. It will be understood that the rod 517 extends, parallel to the pipe 505, across the full length of the pipe. All of the nozzles mounted on the pipe will be connected to the rod 517 as the nozzle illustrated in FIG. 7. The rod 517 can be moved to the left or right as shown by arrow 519, and when the rod 517 is moved to the left, the nozzles will point to the right, and vice versa. The direction of rod movement will again be controlled by the sensing devices.

Thus, all of the nozzles mounted on the pipe 505 will "point" in the same direction during the operation of this arrangement.

Although only jets directed at right angles to the direction of the belt have been considered it is also possible to angle the nozzles so that they are at some other angle to the lengthwise direction of the belt. (See 17*a* and 17*b*, FIG. 2.)

Although several embodiments have been described above, this was for the purpose of illustrating but not limiting the invention. Various modifications which will come readily to the mind of one skilled in the art are within the scope of the invention as defined in the appended claims.

I claim:

1. A guide shower for a paper making machine, said machine comprising at least one endless fabric belt;

said endless fabric belt driven by a driving roll;

said endless fabric belt comprising a high tension portion and a low tension portion, and right and left edges adjacent the right and left side of the machine respectively;

said high tension portion being disposed in that portion of the belt preceding said driving roll in the direction of travel of said belt;

said low tension portion being disposed in that portion of the belt following said driving roll in the direction of travel of said belt;

said guide shower comprising a series of nozzles joined by a pipe for providing fluid under pressure from a means for supplying fluid to said nozzles, said nozzles having outlet ends;

the outlet ends of said nozzles being directed at a surface of said endless fabric belt in said low tension portion thereof, whereby fluid under pressure emerging from said outlet ends impinges on said surface;

said guide shower being disposed across the width of said endless fabric belt;

and wherein said guide shower comprises a right section and a left section;

the nozzles in said right section being directed towards said right edge, and the nozzles in said left section being directed towards said left edge;

and adjustment means, associated with said pipe, for adjusting the pressure at the outlet ends of the nozzles of said right section relative to the pressure at the outlet ends of the nozzles of said left section, whereby to produce a pressure differential between the pressure at the outlet ends of the nozzles of said right section and the pressure at the outlet ends of the nozzles of said left section, to provide a motivating force to guide said endless belt to the right side or left side of the machine.

2. A shower as defined in claim 1 comprising means for providing said fluid under pressure of 400 – 600 psi.

3. A shower as defined in claim 1, wherein said right and left sections are disposed in alignment and end to end across said endless belt, the left section being disposed on the left side of the machine and the right section being disposed adjacent the right side of the machine.

4. A shower as defined in claim 1 wherein said right and left sections are disposed in parallel and side by side across said endless belt.

5. A shower as defined in claim 3 wherein said adjustment means comprises valve means connecting said means for supplying fluid to only one of said right or left sections.

6. A shower as defined in claim 4 wherein said adjustment means comprises valve means connecting said means for supplying fluid to only one of said right or left sections.

7. A shower as defined in claim 3 and comprising a first means for supplying fluid for said right section and a separate second means for supplying fluid for said left section;

and wherein said adjustment means comprises means for varying the pressure of said first and second means for supplying fluid to thereby provide differential pressure at said first and second sections.

8. A shower as defined in claim 4 and comprising a first means for supplying fluid for said right section and a separate second means for supplying fluid for said left section;

and wherein said adjustment means comprises means for varying the pressure of said first and second means for supplying fluid to thereby provide differential pressure at said first and second sections.

9. A shower as defined in claim 3 wherein each of said nozzles forms an angle of less than 90° with said pipe, and is directed at said surface of said endless fabric-belt, the outlet ends of substantially all of said nozzles located in the left section being directed toward the left edge of said fabric, the outlet ends of substantially all of said nozzles located in the right section being directed toward the right edge of said fabric, whereby fluid emerging under pressure from the outlet ends of said nozzles will impinge on said surface of said endless fabric belt and will be directed substantially toward the lateral edges of said endless fabric belt.

10. A shower as defined in claim 4 wherein each of said nozzles forms an angle of less than 90° with said pipe, and is directed at said surface of said endless fabric belt, the outlet ends of substantially all of said nozzles located in the left section being directed toward the left edge of said fabric, the outlet ends of substantially all of said nozzles located in the right section being directed toward the right edge of said fabric, whereby fluid emerging under pressure from the outlet ends of said nozzles will impinge on said surface of said endless fabric belt and will be directed substantially toward the lateral edges of said endless fabric belt.

11. A shower as defined in claim 9 wherein the angles between the nozzles and the pipe increase gradually from left to right in the left section and from right to left in the right section.

12. A shower as defined in claim 10 wherein the angles between the nozzles and the pipe increase gradually from left to right in the left section and from right to left in the right section.

13. A shower as defined in claim 9 wherein the diameters of the outlet ends of the nozzles increase gradually from right to left in the left section and from left to right in the right section.

14. A shower as defined in claim 10 wherein the diameters of the outlet ends of the nozzles increase gradually from right to left in the left section and from left to right in the right section.

15. A shower as defined in claim 1 wherein each of said nozzles is pivotably mounted on said pipe;

means connecting said nozzles whereby all of said nozzles can be pivoted at the same time so that the outlet ends of the nozzles can all be directed towards the right or left edges of said endless belt.

16. A shower as defined in claim 9 wherein the angle between each said nozzle and said pipe is between 10° and 60°.

17. A shower as defined in claim 16 wherein the angle between each said nozzle and said pipe is between 20° and 30°.

18. A shower as defined in claim 10 wherein the angle between each said nozzle and said pipe is between 10° and 60°.

19. A shower as defined in claim 18 wherein the angle between each nozzle and said pipe is between 20° and 30°.

20. A shower as defined in claim 1 wherein said nozzles provide a fish tail type spray having a wide bottom impinging on said fabric, the length of said wide bottom extending in the width of said fabric; and wherein the bottoms of said sprays of adjacent nozzles overlap one another to thereby provide cleansing action over substantially the entire surface of the endless fabric belt.

21. A shower as defined in claim 1 wherein said nozzles provide needle-type jet sprays, means for oscillating said guide shower in the cross-machine direction of said endless fabric belt to provide cleansing action over substantially the entire surface of the endless fabric belt.

22. A method for guiding an endless fabric belt of a paper making machine, the fabric belt being driven by a driving roll;

said endless fabric belt comprising a high tension portion and a low tension portion, and right and left edges adjacent the right and left side of the machine respectively;

said high tension portion being disposed in that portion of the belt preceding said driving roll in the direction of travel of said belt;

said low tension portion being disposed in that portion of the belt following said driving roll in the direction of travel of said belt;

and guide shower disposed across the width of the endless fabric belt, and comprising a series of nozzles joined by a pipe;

the method comprising providing fluid under pressure through said pipe to outlet ends of those nozzles directed towards the left edge of said endless fabric belt;

and providing fluid under pressure through said pipe to the outlet ends of those nozzles directed towards the right edge of said endless fabric belt;

adjusting the pressure at the outlet ends of the nozzles directed towards the left edge to a different pressure from the pressure at the outlet ends of the nozzles directed towards the right edge;

whereby the belt will be guided to the side of the higher pressure.

23. A method as defined in claim 22 wherein said guide shower comprises a right section and a left section;

the nozzles in said right section being directed towards said right edge and the nozzles in said left section being directed towards the left edge;

the method comprising providing fluid under pressure to only said right section to guide said endless fabric belt to the right side of the machine; or providing fluid under pressure to only said left section to guide said endless fabric belt to the left side of the machine.

24. A method as defined in claim 22 wherein said guide shower comprises a right section and left section and wherein fluid under pressure is continuously supplied to both said left section and said right section;

and wherein the pressure of the fluid to said left section is increased relative to the pressure of the fluid of the right section to guide said endless fabric belt to the left side of the machine; or wherein the pressure to the right section is increased relative to the pressure of the left section to guide the endless fabric belt to the right side of the machine.

* * * * *